US009494393B1

(12) United States Patent
Herbage et al.

(10) Patent No.: US 9,494,393 B1
(45) **Date of Patent: *Nov. 15, 2016**

(54) LOW FOREIGN OBJECT DAMAGE (FOD) WEIGHTED NOSE DECOY FLARE

(71) Applicant: Kilgore Flares Company, LLC, Toone, TN (US)

(72) Inventors: David W. Herbage, Jackson, TN (US); Alan Phillips, Jackson, TN (US); Everard Leifson, Jackson, TN (US); Keven Thomas, Toone, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/946,547

(22) Filed: Jul. 19, 2013

Related U.S. Application Data

(62) Division of application No. 13/460,957, filed on May 1, 2012, now Pat. No. 8,813,649, which is a division of application No. 12/764,221, filed on Apr. 21, 2010, now Pat. No. 8,191,478.

(60) Provisional application No. 61/171,270, filed on Apr. 21, 2009.

(51) Int. Cl.
*F42B 4/26* (2006.01)
*F42B 12/42* (2006.01)
*F42B 12/46* (2006.01)

(52) U.S. Cl.
CPC ..... *F42B 4/26* (2013.01); *F42B 12/42* (2013.01); *F42B 12/46* (2013.01)

(58) Field of Classification Search
CPC ..... F42B 4/10; F42B 4/22; F42B 4/26; F42B 12/36; F42B 12/38; F42B 12/42; F42B 12/46; F42B 12/50
USPC ..... 102/336, 345, 347, 348, 352, 360, 377, 102/378
See application file for complete search history.

(56) References Cited

U.S. PATENT DOCUMENTS 3,062,144 A 7/1956 Hori et al.
3,323,456 A 6/1967 Rothman
(Continued)

FOREIGN PATENT DOCUMENTS

EP 0407288 A1 1/1991
GB 2357137 A1 6/2001
JP 2922876 B1 7/1999

OTHER PUBLICATIONS

The United States Patent and Trademark Office As Searching Authority; The International Search Report and Written Opinion of PCT/US2010/031827; Jun. 18, 2010; pp. 1-10; The United States Patent and Trademark Office; US.

*Primary Examiner* — James S Bergin
(74) *Attorney, Agent, or Firm* — Wyatt, Tarrant & Combs, LLP; Stephen C. Hall

(57) ABSTRACT

The present invention discloses a low foreign object damage nose weight for affixing to a either a standard or kinematic decoy flare comprising a thin walled nose cup having a closed end, an open end, an internal cavity, and at least one sidewall attached to said closed end and surrounding said internal cavity; and a metal powder disposed within the internal cavity for weighing down the forward end of the decoy flare, said nose cup capable of being affixed to a forward end of a decoy flare such that said powder is jettisoned from said nose cup upon burn out of a flare pellet subassembly of said decoy flare thereby reducing the weight of the nose cup and the possibility of foreign object damage to aircraft, ground troops, ground equipment and buildings resulting from the falling nose weight.

4 Claims, 6 Drawing Sheets

(56) References Cited

U.S. PATENT DOCUMENTS

| | | | | |
|---|---|---|---|---|
| 3,601,053 | A | 8/1971 | Grall et al. | |
| 3,611,935 | A | 10/1971 | Beckes et al. | |
| 3,670,657 | A | 6/1972 | Evans | |
| 3,855,930 | A | 12/1974 | Mulich et al. | |
| 3,981,241 | A | 9/1976 | Ambrosini et al. | |
| 4,860,657 | A | 8/1989 | Steinicke et al. | |
| 5,783,768 | A | 7/1998 | Jacobson | |
| 6,055,909 | A | 5/2000 | Sweeny | |
| 6,170,399 | B1 | 1/2001 | Nielson et al. | |
| 6,269,747 | B1 | 8/2001 | Strandli et al. | |
| 7,025,001 | B2 * | 4/2006 | Brunn | F42B 7/10 102/336 |
| 7,866,265 | B1 * | 1/2011 | Kravel | F42B 4/26 102/336 |
| 7,908,972 | B2 * | 3/2011 | Brunn | F42B 4/26 102/346 |
| 8,191,478 | B2 * | 6/2012 | Herbage | F42B 10/52 102/336 |
| 8,418,619 | B1 | 4/2013 | Phillips | |
| 8,813,649 | B1 * | 8/2014 | Herbage | F42B 10/52 102/336 |
| 2006/0169165 | A1 | 8/2006 | Brunn | |
| 2013/0112099 | A1 | 5/2013 | Widener et al. | |

* cited by examiner

LOW FOREIGN OBJECT DAMAGE (FOD) WEIGHTED NOSE DECOY FLARE

RELATED APPLICATIONS

This application is a divisional application of and claims the priority of U.S. patent application Ser. No. 12/764,221 filed on Apr. 21, 2010, and U.S. Provisional Patent Application Ser. No. 61/171,270 filed on Apr. 21, 2009, which are both hereby incorporated by reference.

STATEMENT REGARDING SPONSORED RESEARCH OR DEVELOPMENT

Not applicable.

REFERENCE TO A MICROFICHE APPENDIX

Not applicable.

FIELD OF THE INVENTION

The present invention is related to aircraft countermeasures, and more particularly to infrared decoy flares which are utilized to seduce and distract incoming heat-seeking missiles. An increasing problem in the use of decoy flares is their becoming a source of foreign object damage (FOD) to the launching aircraft as well as ground troops, equipment and structures.

BACKGROUND OF THE INVENTION

Aircraft launched flares are used for purposes such as illumination, signaling, marking, decoy countermeasures and the like. Decoy flares conventionally comprise a hot-burning composite material which is formed into a desired shape. The shape generally corresponds to the shape of the storage container or dispenser can from which the flare is ejected by the aircraft. A variety of cross-sectional shapes are used, for example, flares generally have a circular, square, or rectangular cross-section.

A number of heat seeking missiles have seekers that incorporate rate biased counter-countermeasures which reject decoys not exhibiting forward motion relative to the targeted aircraft. Missile rich theaters of military operation have lead to initiatives to increase the effectiveness of infrared decoy flares deployed from aircraft. In the area of countermeasures, flares are now designed to defeat the most sophisticated heat-seeking missiles.

Unlike standard decoy flares which are dropped from aircraft like "hot bricks", certain infrared flare countermeasure devices are designed to fly a predetermined trajectory alongside an aircraft. One method employed in countermeasures to mimic aircraft trajectory is to replace the conventional open burning decoy flare with a kinematic (or self propelled) flare. While kinematic flares are most suitable for high speed and high altitude applications, in low altitude and slow applications, a kinematic flare would have a lower IR output than an open burning flare.

Another method is to fire or launch the flares in a forward direction. To facilitate this method, a weighted nose is added to the standard flare design to improve the flare's forward fired ballistic performance. This relatively simple low cost improvement increases the distance the flare flies in the forward direction and improves effectiveness by providing enhanced decoy trajectory. It also reduces the size of the dispersion cone of the flare allowing the flare dispensers to be aimed in a more forward and upward direction for further improved effectiveness of the entire flare suite. Flares with ballistic nose weights travel approximately twice as far before burnout as do standard flares. Nose weights are used with both kinematic and standard flares.

Current standard flare containers are usually a cylindrical, square, or rectangular cartridge case, open at one end. The flare is built-up in the cartridge case, optionally including a nose weight at the front, or open end of the cartridge case. The nose weight is typically a solid metal weight comprised of, for example, brass, steel, tungsten alloy, or sintered tungsten. If employed, the nose weight is fixed securely into position, lest it come loose and interrupt the flight-path of the flare. As related later, the inclusion of the nose weight poses a potentially damaging event due to the potential for, after the propulsion is expended, the falling flare nose to strike ground personnel, equipment or buildings or be ingested into aircraft engines of aircraft operating in the combat area. This is an emerging issue as weighted nose flares have been deployed in increasing numbers in recent years and heat seeking missiles are now being employed against an attacking helicopter assault, which may include advancing ground forces. The shoulder fired heat seeking missile has become a great threat to low flying aircraft in these types of operations. Spent noses from decoy flares can be ingested by aircraft engines, i.e. helicopter engines, causing catastrophic failure, and ultimately causing the aircraft to crash. The possibility of a spent metal nose getting into the intake of an adjacent aircraft's engine and damaging its turbine blades also exists on kinematic decoy flares with weighted noses. Likewise, the falling nose from that high altitude has the potential to cause great damage to personnel, civilians, equipment or buildings on the ground.

Earlier standard designs utilize decoy flares without nose weights; however these are generally of significantly inferior performance since the trajectory disintegrates as the propulsion cartridge burns and the center of gravity and internal inertia shift and diminish. Accordingly the inclusion of a nose weight is considered an important inclusion. The benefit of inclusion of the nose weighted flare is that when forward fired, the flare will travel approximately twice as far prior to burn-out. This is attributed to the shifting of the center of gravity of the flare forward which keeps it from tumbling. The significance of the enhanced forward travel of the flare is its increased likelihood of attracting the rate-biased infrared missile seekers as the flare remains in flight as a target for a longer period.

The present invention includes a weighted nose through the inclusion of a thin walled nose cup which is filled with a high-density metal powder which will dump at the end of the propellant burn and render the residual of the nose weight harmless to adjacent aircraft and personnel and material on the ground.

It is an objective of the present invention to avoid the FOD problems associated with the classic solid metal weighted nose flare designs by utilizing a thin walled cup filled with high-density metal powder as a ballistic weight to mass stabilize the flare. Because the metal powder dumps from the nose cup once the flare has burned out leaving the very light weight nose cup as the only residual solid object, the present invention virtually eliminates the possibility of FOD. Another objective of the present invention is to create a nose weight design that is lower in cost than one utilizing a machined metallic forward closure.

SUMMARY OF THE INVENTION

The low FOD weighted nose decoy flare of the present invention can utilize either standard flares or kinematic flares. The standard low FOD weighted nose decoy flare of the present invention comprises a hollow cartridge case for containing a standard flare prior to deployment from an aircraft. The cartridge case may be any cross-sectional shape suitable for flare deployment, for example circular, square or rectangular. The cartridge case is made of a thin, light weight material, for example aluminum, plastic or other light weight, thin walled materials are suitable. The forward end of the cartridge case is open such that the flare may be ejected from the cartridge case at its forward end. A flare pellet subassembly, sometimes call the flare grain subassembly, is disposed inside the flare case. Any suitable subassembly for use with a standard weighted nose decoy flare is used in the standard low FOD weighted nose decoy of the present invention. The flare pellet subassembly can take many shapes and forms. Those of skill in the art will recognize than many types of standard flare pellet subassemblies are suitable for inclusion in the flare case, such as standard or spectrally balanced, pressed, extruded, or cast.

A nose cup, having a closed end, an open end, an internal cavity and at least one side wall surrounding the internal cavity, is positioned at the forward, open end of the cartridge case. The nose cup is made of a thin, light weight material which may be partially burned back as the combustion of the forward end of the flare pellet subassembly progresses, for example aluminum or plastic. The side walls of the nose cup extend inside the cartridge case and overlap said flare pellet subassembly such that the internal cavity is intermediate to the forward end of the flare pellet subassembly and the nose cup. A means for affixing the nose cup to the flare pellet subassembly is intermediate to said nose cup and the side wall of said flare pellet subassembly. For example, an adhesive may be used. A high density metal powder is disposed within the internal cavity. The powder is capable of being jettisoned from the nose cup when the flare pellet subassembly is spent. Those of skill in the art will recognize than many high density metal powders are suitable for this application such as tungsten, iron, lead, tungsten carbide, and Kinertium (tungsten alloy).

In one embodiment, an end cap is removably affixed to the open end of the cartridge case. The end cap protects the standard low FOD weighted nose decoy flare from environmental conditions and handling issues which might damage the flare. The end cap is expelled as the flare is deployed from the aircraft.

The kinematic low FOD weighted nose decoy assembly of the present invention comprises a hollow, enclosed flare housing for containing a kinematic flare pellet subassembly. The flare housing may be any cross-sectional shape suitable for a kinematic flare pellet subassembly, for example circular, square or rectangular. The flare housing is made of a thin, light weight material, for example aluminum, plastic or other light weight, thin walled materials are suitable. An end plate is affixed to the aft end of the flare housing, sealing off the flare housing. A means for propelling the flare pellet subassembly is disposed at the rear or aft end of the flare housing. Those of skill in the art will recognize that there are many available means for propelling the kinematic flare which are suitable for this application, for example, a motor can be used at the aft end of the flare housing. Alternatively, the flare housing may be a pressure vessel with a hole in the end plate at the aft end whereby when the flare burns, gases escape through the hole propelling the flare housing forward. Fins may be attached to the aft end of the flare housing.

A flare pellet subassembly is disposed inside the flare housing adjacent the propulsion means. For example, the flare pellet subassembly can be cast in place or fabricated separately and bonded in place in a kinematic flare. Any suitable flare pellet subassembly for use with a kinematic decoy flare is used in the kinematic low FOD weighted nose decoy of the present invention. Those of skill in the art will recognize than many types of kinematic flare pellet subassemblies are suitable for inclusion in the flare housing, such as cast, extruded, pressed and either standard or spectrally balanced. Infrared flares are suitable for use with the kinematic low FOD weighted nose decoy flare.

A nose cup, having a closed end, an open end, an internal cavity and at least one side wall surrounding the internal cavity, is adjacent to the forward end of the flare housing. The nose cup is made of a thin, light weight metal, for example aluminum or plastic. A bulkhead is affixed to the forward end of the flare housing. The bulkhead seals off the forward end of the flare housing allowing the pressurization of the case thus facilitating propulsion. The internal cavity is intermediate to the closed end of the nose cup and the bulkhead. A high density metal powder is disposed within the internal cavity. The powder is capable of being jettisoned from the nose cup when the flare pellet subassembly is spent. Those of skill in the art will recognize that many high density metal powders are suitable for this application such as tungsten, iron, lead, tungsten carbide, and Kinertium (tungsten alloy).

The side wall of the nose cup is attached to the bulkhead. A means for separating the nose cup from the flare housing after the flare pellet subassembly is spent is intermediate to the nose cup and flare housing. The present invention discloses several means for separating the nose cup from the flare housing. For example in one embodiment of the kinematic flare, a pyrotechnic delay with burster output is attached to the bulkhead extending into the nose cup and timed to explode once the flare has burned out, thereby rupturing and releasing the nose cup from the flare housing and expelling the metal powder from the nose cup.

It is beneficial in both the standard and kinematic low FOD weighted nose decoy flare assembly to maximize the powder jettisoned once the flare pellet subassembly is spent. One means of maximizing the powder jettison is to alter the nose cup after the flare pellet subassembly is spent so that it becomes aerodynamically unstable and tumbles through the air thereby spilling the metal powder. In one embodiment for use with a standard flare, the interface between the forward end of the flare pellet subassembly and the side wall of the nose cup is important. The heat from the burning of the flare also destroys a portion of the side wall of the nose cup. With the disintegration of its container, the powder is spilled from the nose cup. Additionally, the dimension change in the nose cup makes it aerodynamically unstable causing it to tumble through the air and spill its contents. In another embodiment for use with a kinematic flare, a mechanism is employed to separate the nose cup from the flare housing, for example by rupturing the nose cup. The force of the rupturing mechanism causes the nose cup to swing away from the bulkhead thereby jettisoning the powder from the nose cup.

In another embodiment for a standard flare, an energetic binder is added to the metal powder in the nose cup. The heat from the flare grain ignites the energetic binder and the gases produced expel the metal powder from the nose cup. Additionally, the heat in the nose cup may cause it to rupture and/or destroy a portion of the side wall of the nose cup thereby expelling more metal powder and making the nose cup aerodynamically unstable. Those of skill in the art will recognize that there are many energetic binders that could be used, for example, glycidal azide polymer (GAP).

In another embodiment for use with either a kinematic or standard flare, rapid deflagration cord (RDC) is embedded in the metal powder and in contact with the flare pellet subassembly. The RDC is ignited from the flare upon burn out of the flare. Upon ignition, the RDC rapidly generates pressure in the nose cup which will jettison the metal powder from the nose cup. The RDC may be in any shape that promotes the ignition of the RDC and jettison of the metal powder, for example a coil shape may be used. In an embodiment where the flare is a kinematic flare, it is necessary to separate the nose cup and the flare housing. The ignition end of the RDC intersects the bulkhead and enters the flare housing so that it may contact the forward end of the flare pellet subassembly. The ignition end is positioned so that its ignition occurs upon the burn out of the flare pellet subassembly. Upon ignition, the nose cup ruptures due to the pressure created by the burning RDC, causing the nose cup to separate from the bulkhead. Alternatively, a blend of metal powder and an energetic binder (for example GAP) may be added to the nose cup for use with either a standard or kinematic flare to increase the burning/explosive force.

In yet another embodiment for use with a kinematic flare, a through-bulkhead initiator is employed as a means to separate the nose cup from the flare housing. A hole traverses the bulkhead from the flare housing to the nose cup. A heat transfer conduit is disposed inside said hole. Said heat transfer conduit has a flange at one end internal to said flare housing which seals the flare housing. An internal cavity is disposed within said heat transfer conduit and is axially aligned with said hole in said bulkhead. A first end of said cavity is adjacent to said flange, a second end of said cavity is adjacent to said nose cup and has an opening adjacent to said nose cup. An explosive material is disposed inside said internal cavity of said heat transfer conduit. The flange is adjacent to the forward end of the flare pellet subassembly and heats up upon burn out of the flare pellet subassembly. Upon heating of the flange, the heat is transferred to through the heat transfer conduit to the explosive material which ignites, rupturing the nose cup and expelling the powder from the nose cup thereby reducing the weight of the nose cup. In some embodiments, the flange of the heat transfer conduit has a thin section aligned with the first end of said cavity thereby facilitating the heating of the explosive material.

Accordingly, it is an object of the present invention to provide an improved aerodynamic countermeasure flare wherein the nose weight is comprised of a high density metallic powder contained in a cup-like container in the nose of the flare, where the powder is unconstrained and may flow out of the cup at the completion of the flare burn such that the remaining casing is a light-weight shell of much reduced danger as foreign object damage. It is another object of the present invention to identify a metal powder dense enough to serve as an effective nose weight which changes the trajectory of the flare, but which is sufficiently dense as to not displace a significant amount of volume used by the flare pellet subassembly. Another object of the present invention is to design a light weight container to hold the metal powder. Yet another object of the present invention is to devise a means to maximize the powder jettison from the nose cup upon burn out of the flare.

Various refinements exist of the features noted in relation to one or more of the above-described aspects of the present invention. Further features may also be incorporated into one or more of those aspects as well. These refinements and additional features may exist individually or in any combination. For instance, the various features discussed below in relation to the illustrated embodiments may be employed in any of the aspects, individually or in any combination.

DETAILED DESCRIPTION OF PREFERRED EMBODIMENTS

Figure 1:
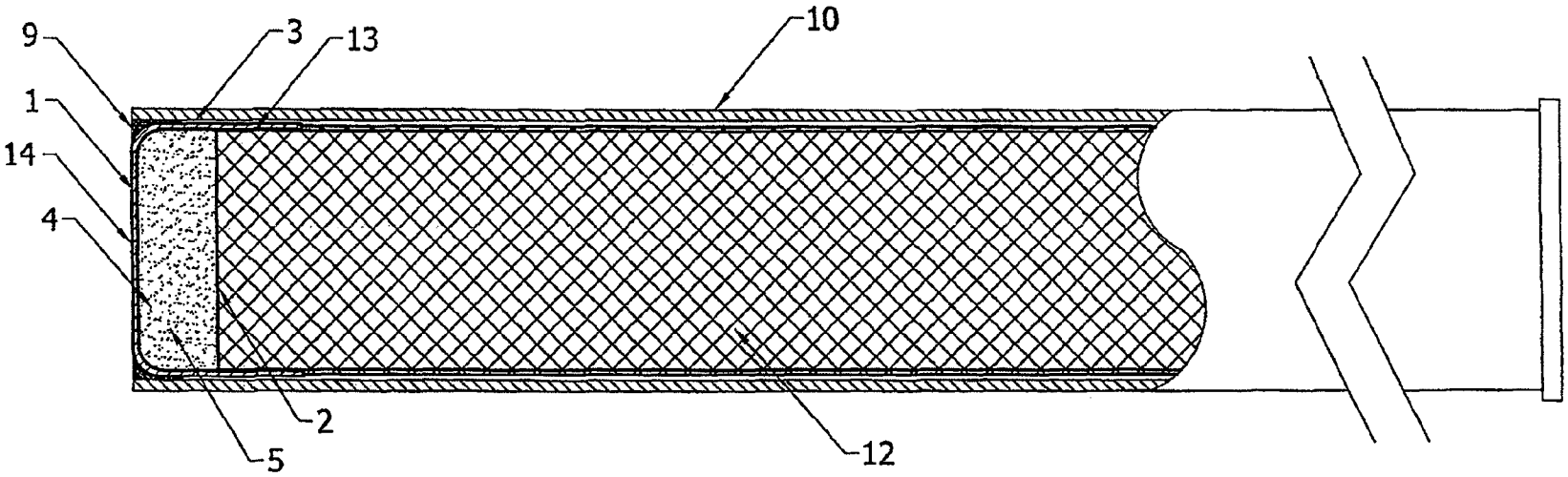
FIG. 1 is a cross-sectional view of a standard low FOD weighted nose decoy flare of the present invention.

The present invention will now be described in relation to the accompanying drawings, which at least assist in illustrating the various pertinent features thereof. Referring now to FIG. 1, the standard low FOD weighted nose decoy flare of the present invention comprises a hollow cartridge case 10 for containing a standard flare, such as the flare pellet subassembly 12, prior to deployment from an aircraft. The cartridge case 10 may be any cross-sectional shape suitable for flare deployment, for example circular, square or rectangular. The cartridge case 10 is made of a thin, light weight material, for example aluminum, plastic or other light weight, thin walled materials are suitable. The cartridge case 10 has an opening 9 at its forward end such that the flare pellet subassembly 12 may be ejected from the cartridge case 10 at its forward end. A flare pellet subassembly 12 is disposed inside the cartridge case 10 for mimicking the heat signature of an aircraft thereby serving as a decoy for a target missile upon ejection from the target aircraft. Any suitable subassembly for use with a standard weighted nose decoy flare is used in the standard low FOD weighted nose decoy of the present invention. Those of skill in the art will recognize than many types of standard flare pellet subassemblies are suitable for inclusion in the cartridge case, such as cast, extruded, pressed and either standard or spectrally balanced. Infrared flares are also suitable for use as the flare pellet subassembly 12 of the present invention.

A nose cup 14, having a closed end 1, an open end 2, an internal cavity 4 and at least one side wall 3 surrounding the internal cavity 4, is positioned adjacent to the flare pellet subassembly 12 at the forward, open end of the cartridge case 10. The nose cup 14 is made of a thin, light weight material which may be partially burned back as the combustion of the forward end of the flare pellet subassembly 12 progresses, for example aluminum or plastic. The side walls 3 of the nose cup extend inside the cartridge case 10 and overlap said flare pellet subassembly 12 such that the internal cavity 4 is intermediate to the flare pellet subassembly 12 and the nose cup 14. A means for affixing the nose cup 14 to the flare pellet subassembly 12 is intermediate to said nose cup 14 and said flare pellet subassembly 12. For example, an adhesive 13, such as epoxy or similar catalyzed bonding system, may be used. In some embodiments, it is beneficial to use a flammable adhesive 13 whereby the adhesive 13 burns away when the heat from the forward end of the flare pellet subassembly 12 reaches it so that the nose cup 14 can also burn away. Cyanoacrylate is such a flammable adhesive 13.

A metal powder 5 is disposed within the internal cavity 4 for providing the overall balance and trim for weighing down the nose cup whereby the flare assembly will mimic the trajectory of the target aircraft. The powder 5 is capable of being jettisoned from the nose cup 14 when the flare pellet subassembly 12 is spent. Those of skill in the art will recognize than many metal powders are suitable for this application such as tungsten, iron, lead, tungsten carbide, and Kinertium (tungsten alloy). The metal powder 5 should be dense enough to weigh down the nose of the flare enough to effect the trajectory of the flare without taking significant volume away from the flare pellet subassembly 12. Powders with a bulk density of 8.0 grams per cubic centimeter or greater are particularly suitable for use in the nose cup 14 of the present invention. In some embodiments, the metal powder 5 is a high density metal powder such as high density tungsten powder which has a density ranging between 11.0 to 11.3 grams per cubic centimeter.

Figure 2:
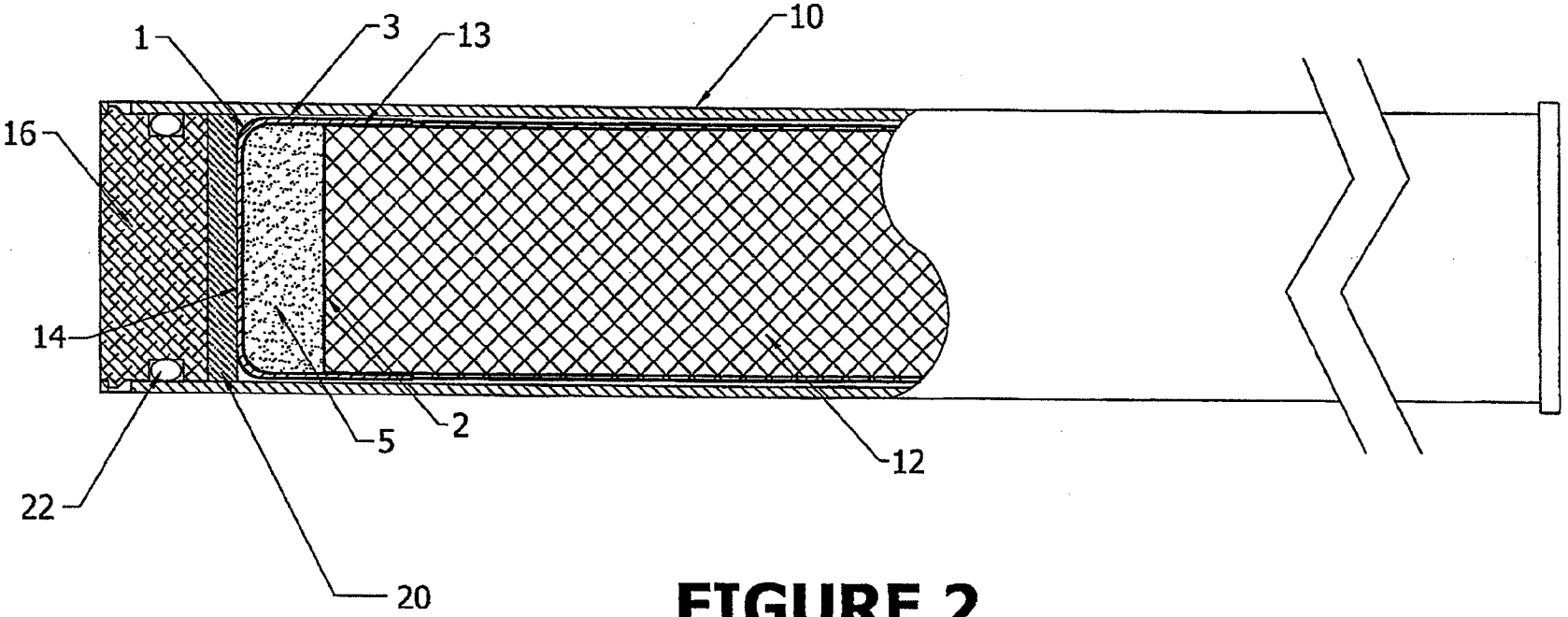
FIG. 2 is a cross-sectional view of an alternative construction of standard low FOD weighted nose decoy flare of the present invention.

In one embodiment as shown in FIG. 2, an end cap 16 is removably affixed to the opening 9 at the forward end of the cartridge case 10. The cartridge case 10 extends beyond the nose cup 14 and the end cap 16 is disposed inside the cartridge case 10. The end cap 16 protects the standard low FOD weighted nose decoy flare from environmental conditions and handling issues which might damage the flare. The end cap 16 is expelled as the flare is deployed from the aircraft. A spacer 20, preferably made of felt, is disposed between the end cap 16 and the nose cup 14. Disposed intermediate the end cap 16 and the walls of case 10 is an O-ring 22 which provides a seal between the end cap 16 and the cartridge case 10. The disclosed end cap 16 is of a configuration currently used on the M206 IR Flare which is a part of the Three Flare countermeasure solution for helicopters; however, other configurations of other specific flares may be used.

Figure 3:
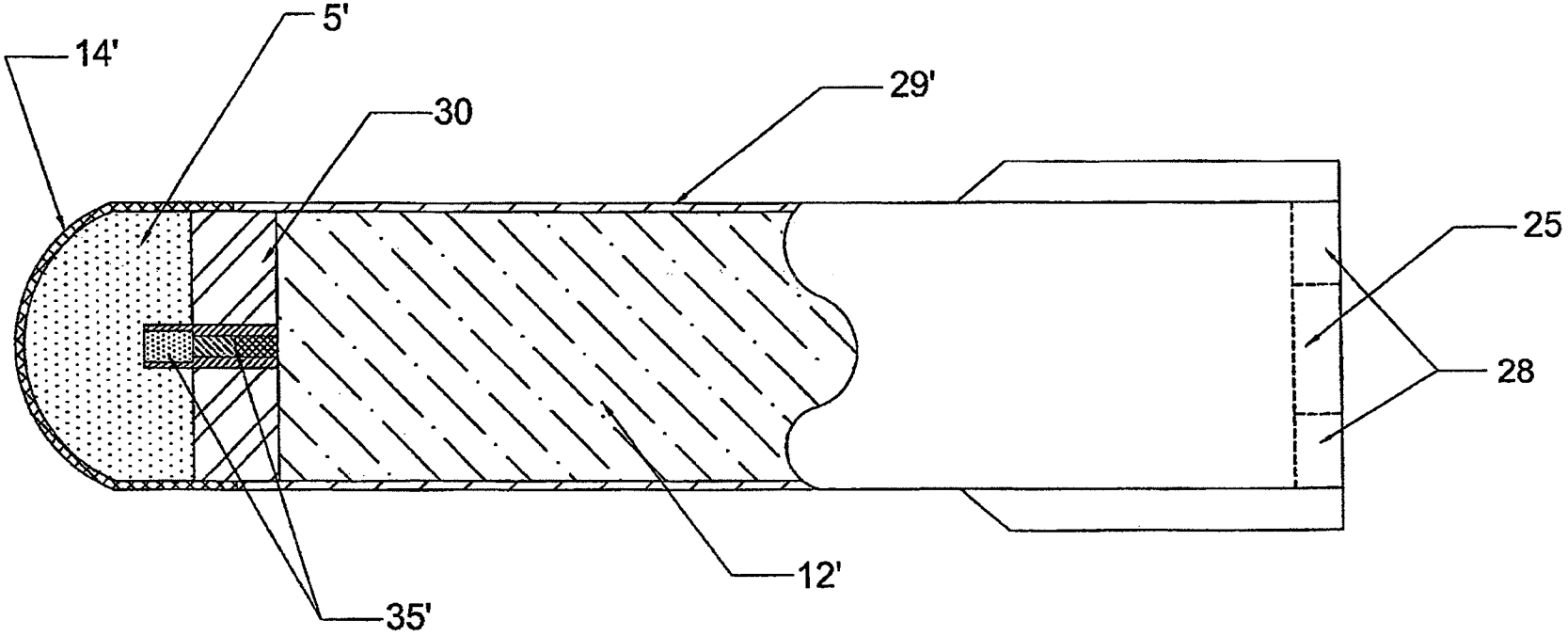
FIG. 3 is a cross-sectional view of a kinematic low FOD weighted nose decoy flare of the present invention.

Referring now to FIG. 3, the kinematic low FOD weighted nose decoy flare of the present invention comprises a hollow, enclosed flare housing 29 for containing a kinematic flare pellet subassembly 12'. The flare housing 29 may be any cross-sectional shape suitable for a kinematic flare assembly, for example circular, square or rectangular. The flare housing 29 is made of a thin, light weight material, for example aluminum, plastic or other light weight, thin walled materials are suitable. A means for propelling the flare housing is disposed at the rear or aft end of the flare housing 29. An end plate 28 is affixed to the aft end of the flare housing 29 and seals the aft end. Those of skill in the art will recognize that there are many available means for propelling the kinematic flare which are suitable for this application, for example, a motor (not shown), such as a rocket motor, can be used at the aft end of the flare housing 29. Alternatively, the flare housing 29 may be a pressure vessel having a hole 25 in end plate 28 whereby when the flare pellet subassembly 12' burns, gases escape through the hole 25 propelling the flare forward.

A flare pellet subassembly 12' is disposed inside the flare housing 29 adjacent the propulsion means. For example, the flare pellet subassembly 12' may be cast in place (case bonded) or separately assembled and inserted/bonded into the flare housing 29. Any suitable flare pellet subassembly 12' for use with a kinematic decoy flare is used in the kinematic low FOD weighted nose decoy of the present invention. Those of skill in the art will recognize than many types of kinematic flare pellet subassemblies 12' are suitable for inclusion in the flare housing 29, such as standard and spectrally balanced flare pellet subassemblies.

A bulkhead 30 is intermediate to the flare grain 12' and the nose cup 14'. The bulkhead 30 is made of a metal or composite structural material such as resin bonded carbon or resin bonded glass fiber. The bulkhead 30 seals off the forward end of the flare housing 29 allowing the pressurization of the flare housing 29 thus facilitating propulsion. A nose cup 14', having a closed end 1', an open end 2', an internal cavity 4' and at least one side wall 3' surrounding the internal cavity 4', is affixed to the bulkhead 30. The nose cup 14' is made of a thin, light weight metal, for example aluminum or plastic. The internal cavity 4' is intermediate to the closed end 1' of the nose cup and the bulkhead 30. A metal powder 5' is disposed within the internal cavity 4'. The powder 5' is capable of being jettisoned from the nose cup 14' when the flare pellet subassembly 12' is spent. Those of skill in the art will recognize that many metal powders are suitable for this application such as tungsten, iron, lead, tungsten carbide, and Kinertium (tungsten alloy). The metal powder should be dense enough to weigh down the nose of the flare enough to effect the trajectory of the flare without taking significant volume away from the flare pellet subassembly 12'. Powders with a bulk density of 8.0 grams per cubic centimeter or greater are particularly suitable for use in the nose cup 14' of the present invention. In some embodiments, the metal powder 5 is a high density metal powder such as high density tungsten powder which has a density ranging between 11.0 to 11.3 grams per cubic centimeter.

The side wall 3' of the nose cup 14' is attached to bulkhead 30. A means for separating the nose cup 14' from the cartridge case 35 after the flare pellet subassembly 12' is spent is intermediate to the nose cup 14' and forward end of the flare housing 29. Once the flare pellet subassembly 12' is spent and, in the case of a kinematic flare a mechanism is employed to separate the nose cup 14' from the flare housing 29, for example by rupturing the nose cup. The force of rupturing mechanism causes the nose cup 14' to swing away from the bulkhead 30 thereby jettisoning the powder 5 from the nose cup 14'. It is beneficial to ensure that the maximum amount of metal powder 5 is expelled from the nose cup 14'. The present invention discloses several means of separating the nose cup 14' from the flare housing 29 resulting in the jettisoning of the powder 5 from the nose cup 14'. For example, the nose cup 14' is separated from the flare housing 29 by placing a flammable element in the nose cup 14' which is ignited by the flare pellet subassembly thereby pressurizing the cup 14' and expelling the powder 5 as the nose cup 14'. In the case of a kinematic flare, the flammable element is intermediate to the forward end of the flare housing 29 and the nose cup 14'.

In one embodiment for a kinematic flare, a pyrotechnic delay with burster output 35' is attached to the bulkhead 30 and extends into the nose cup 14'. The pyrotechnic delay is timed to explode once the flare has burned out, thereby rupturing the side wall 3' of the nose cup 14' and releasing the nose cup 14' from the flare housing 29 and expelling the metal powder 5' from the nose cup 14'.

As shown in FIGS. 1 and 2 in some embodiments for standard flares, the interface between the forward end of the flare pellet subassembly 12 and the side wall 3 of the nose cup 14 is important. In these embodiments, the jettisoning means comprises an adhesive 13 applied intermediate to the side wall 3 of the nose cup 14 and the flare pellet subassembly 12. The heat from the burning of the flare pellet subassembly 12 also destroys both the adhesive 13 and a portion of the side wall 3 of the nose cup 14. With the disintegration of its container, the powder 5 is spilled from the nose cup 14. Additionally, the dimension change in the nose cup 14 makes it aerodynamically unstable causing it to tumble through the air and spill its contents. In some embodiments, a flammable adhesive such as cyanoacrylate is used.

Figure 4:
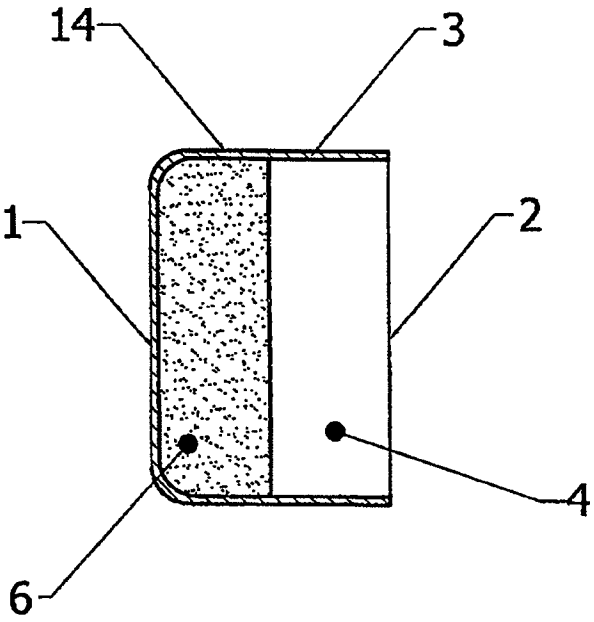
FIG. 4 is a cross sectional view of one embodiment of the nose cup of the present invention containing a powder jettisoning means.

In some embodiments a flammable element is added to the powder 5 so that the flammable element is ignited by the flare pellet subassembly 12. In a standard flare, the gases produced expel the powder 5 from the nose cup 14 upon ignition. In a kinematic flare, the nose cup 14' is pressurized upon ignition of the flammable element and ruptures. Referring now to FIG. 4 in another embodiment, a blend of energetic binder and metal powder 6 is added to the nose cup 14. Those of skill in the art will recognize that many energetic binders are suitable, for example, glycidal azide polymer (GAP). The binder displaces the air gaps in the powder and does not increase the volume of material in the cup 14. The heat from the forward end of the burning flare pellet subassembly 12 ignites the energetic binder and expels the binder/metal powder mixture 6 from the nose cup 14. Additionally, the heat in the nose cup 14 may cause the nose cup 14 to rupture and/or destroy a portion of the side wall 3 of the nose cup 14 thereby expelling more metal powder 5 and making the nose cup 14 aerodynamically unstable. In an embodiment utilizing a standard flare, the binder/powder blend 6 is in contact with the forward end of the flare pellet subassembly 12 allowing direct ignition of the binder. In an embodiment utilizing a kinematic flare, the bulkhead 30 separates the binder/powder blend 6 from the flare pellet subassembly 12'. An ignition means intersects the bulkhead 30 connecting the flare pellet subassembly 12' to the binder/powder blend 6 in this embodiment as described below.

Figure 5:
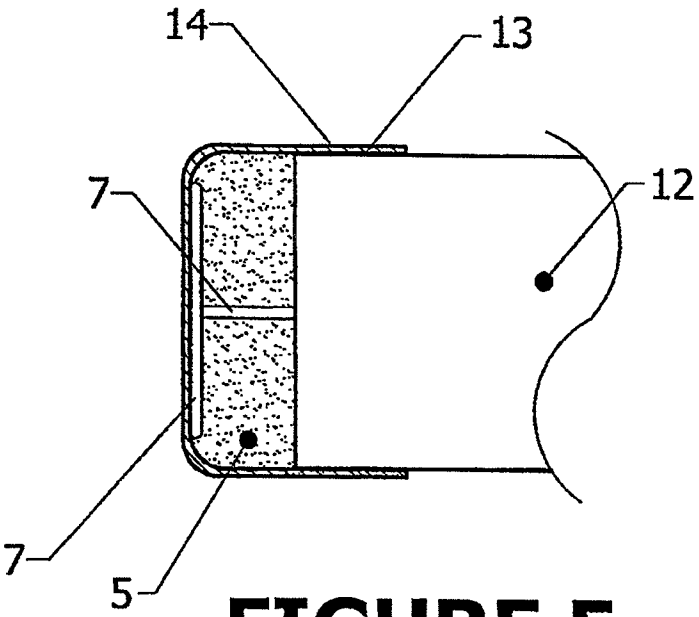
FIG. 5 is a cross sectional view of an alternative embodiment of the nose cup of the present invention containing an alternative powder jettisoning means.

In yet another embodiment as shown in FIG. 5, the separating means comprises a rapid deflagration cord (RDC) 7 which is embedded in the metal powder 5 and in contact with forward end of the flare pellet subassembly 12'. Alternatively, a mixture of energetic binder/powder 6 (not shown) may be added to the nose cup 14'. The RDC 7 is ignited from the flare pellet subassembly 12' upon burn out of the flare pellet subassembly 12'. Upon ignition, the burning of the RDC 7 rapidly generates pressure in the nose cup 14' causing the nose cup to rupture which jettisons the metal powder 5 from the nose cup 14. The RDC 7 may be in any shape that promotes the ignition of the RDC 7, pressurization of the nose cup 14 and jettison of the metal powder 5, for example a coil shape may be used. RDC is a non-detonating metal sheathed transfer cord that burns at a rate of approximately 1000 ft/sec.

Figure 6:
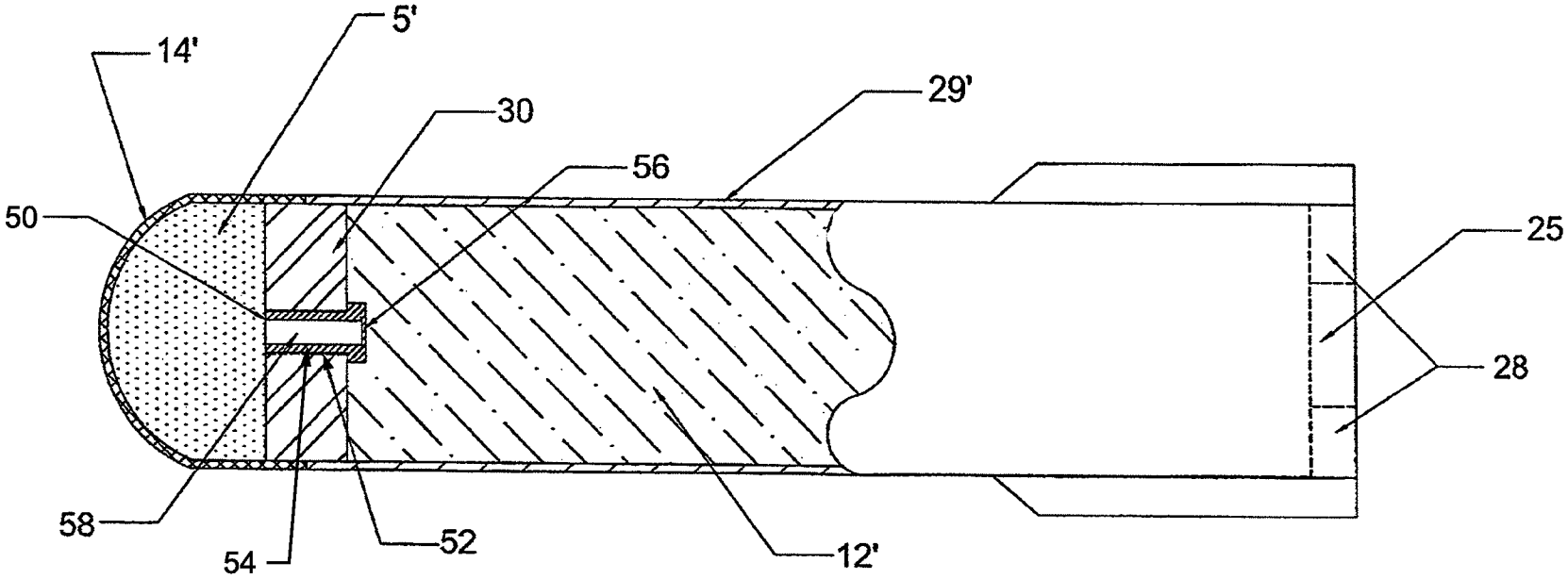
FIG. 6 is a cross-sectional view of an alternative embodiment of a kinematic low FOD weighted nose decoy flare of the present invention.

Referring now to FIG. 6, in yet another embodiment for use with a kinematic flare, a through-bulkhead initiator 50 is employed as a means to separate the nose cup 14' from the flare housing 29. A hole 52 traverses the bulkhead from the flare housing 29 to the nose cup 14'. A heat transfer conduit 54 is disposed inside said hole 52. Said heat transfer conduit 54 has a flange 56 at one end internal to said flare housing 29 which seals the flare housing 29. An internal cavity 58 is disposed within said heat transfer conduit 54 and is axially aligned with said hole 52 in said bulkhead. A first end of said cavity 58 is adjacent to said flange 56, a second end of said cavity is adjacent to said nose cup 14' and has an opening adjacent to said nose cup 14'. An explosive material (not shown) is disposed inside said internal cavity 58 of said heat transfer conduit 54. The flange 56 is adjacent to the forward end of the flare pellet subassembly 12' and heats up upon burn out of the flare pellet subassembly 12'. Upon heating of the flange 56, the heat is transferred to through the heat transfer conduit 54 to the explosive material which ignites rupturing the nose cup 14' and expelling the powder 5 from the nose cup 14' thereby reducing the weight of the nose cup 14'. In some embodiments, the flange 56 of the heat transfer conduit 54 has a thin section (not shown) aligned with the first end of said cavity 58 thereby facilitating the heating of the explosive material.

The heat transfer conduit 54 may be made of any conductive material, for example stainless steel or carbon steel. The explosive material may be any quickly exploding material suitable for adding to the internal cavity 58 with a low explosion temperature of approximately 250 degrees Fahrenheit. Those of skill in the art will recognize that there are many suitable explosive materials such as double base powders and propellants. The explosive material can be added to the internal cavity 58 in powder form or coated on the side walls of the internal cavity.

Those skilled in the art will appreciate that certain modifications can be made to the system and methods herein disclosed with respect to the illustrated embodiments, without departing from the spirit of the instant invention. While the invention has been described above with respect to the preferred embodiments described, it will be understood that the invention is adapted to numerous rearrangements, modifications, and alterations, and all such arrangements, modifications, and alterations are intended to be within the scope of the appended claims.

What is claimed is:

1. A low foreign object damage nose weight for affixing to a kinematic decoy flare having a forward end and an aft end defining an enclosed, hollow flare housing capable of being pressurized, a flare pellet subassembly and a propulsion means, said flare housing having a bulkhead affixed to a forward end of said flare housing and an endplate affixed to an aft end of said flare housing thereby enclosing said flare housing, said flare pellet subassembly disposed inside said flare housing, comprising:

a thin walled nose cup having a closed end, an open end, an internal cavity, and at least one sidewall attached to said closed end and surrounding said internal cavity; and a metal powder disposed within the internal cavity for weighing down the forward end of the decoy flare, said nose cup capable of being affixed to a forward end of a decoy flare such that said powder is jettisoned from said nose cup upon burn out of a flare pellet subassembly of said decoy flare; and a means for separating said nose cup from said flare housing upon burn out of the flare pellet subassembly whereby the metal powder is spilled from the nose cup thus reducing the weight of the nose cup.

2. The nose weight of claim 1 wherein:

the separation means comprises a pyrotechnic delay having a burster output timed to explode upon burn out of the flare pellet subassembly attached to the bulkhead and extending into the nose cup whereby the detonation of said pyrotechnic delay ruptures said nose cup separating said nose cup from said flare housing and expelling said metal powder from said nose cup.

3. The nose weight of claim 1 wherein:

a hole traverses said bulkhead from said flare housing to said nose cup; and the separation means is a through-bulkhead initiator disposed inside said hole comprising a heat transfer conduit for transferring heat from said flare pellet subassembly and an explosive material for rupturing said nose cup, said heat transfer conduit having a flange at one end adjacent to a first side of said bulkhead and internal to said flare housing sealing said flare housing and an internal cavity axially aligned with said hole in said bulkhead, a first end of said cavity adjacent to said flange, a second end of said cavity adjacent to said second side of said bulkhead and open to said nose cup, an explosive material disposed inside said cavity for pressurizing and rupturing said nose cup thereby, separating said nose cup from said flare housing thus expelling powder from said nose cup.

4. The nose weight of claim 3 wherein:

the flange of the heat transfer conduit has a thin section aligned with the first end of said cavity thereby facilitating the heating of the explosive material.

* * * * *